US008194899B2

(12) United States Patent
Naylor

(10) Patent No.: US 8,194,899 B2
(45) **Date of Patent: *Jun. 5, 2012**

(54) METHOD FOR IMPROVING THE FITTING OF HEARING AIDS AND DEVICE FOR IMPLEMENTING THE METHOD

(75) Inventor: Graham Naylor, Allerød (DK)

(73) Assignee: Oticon A/S, Smørum (DK)

( * ) Notice: Subject to any disclaimer, the term of this patent is extended or adjusted under 35 U.S.C. 154(b) by 26 days.

This patent is subject to a terminal disclaimer.

(21) Appl. No.: 12/805,384

(22) Filed: Jul. 28, 2010

(65) Prior Publication Data

US 2011/0058681 A1 Mar. 10, 2011

Related U.S. Application Data

(63) Continuation of application No. 11/588,353, filed on Oct. 27, 2006, now Pat. No. 7,783,066, which is a continuation of application No. 10/169,793, filed as application No. PCT/DK01/00038 on Jan. 18, 2001, now abandoned.

(30) Foreign Application Priority Data

Jan. 21, 2000 (DK) ..... 2000 00110

(51) Int. Cl.
*H04R 25/00* (2006.01)

(52) U.S. Cl. ..... 381/312; 381/314

(58) Field of Classification Search ..... 381/58, 381/60, 312, 314; 73/585; 600/559
See application file for complete search history.

(56) References Cited

U.S. PATENT DOCUMENTS 5,202,927 A * 4/1993 Topholm ..... 381/315
5,710,819 A * 1/1998 Tøpholm et al. ..... 381/316
6,083,156 A * 7/2000 Lisiecki ..... 600/301

* cited by examiner

*Primary Examiner* — Tuan Nguyen
(74) *Attorney, Agent, or Firm* — Birch, Stewart, Kolasch & Birch, LLP

(57) ABSTRACT

The invention relates to a method for fitting a hearing aid to the needs of a hearing aid user, the method comprising collecting statistical data characterizing physical or psychological properties of environments in which use of the hearing aid is desired and utilizing the statistical values for the adjustment of the signal processing in the hearing aid, such statistical data having influence even though they may have been collected prior to the wearer's first or current period of listening via the hearing aid. The invention further relates to a device for implementing the method.

9 Claims, 2 Drawing Sheets

METHOD FOR IMPROVING THE FITTING OF HEARING AIDS AND DEVICE FOR IMPLEMENTING THE METHOD

CROSS REFERENCE TO RELATED APPLICATION

This application is a continuation of application Ser. No. 11/588,353, filed Oct. 27, 2006 now U.S. Pat. No. 7,783,066, which was a continuation of application Ser. No. 10/169,793, filed Sep. 24, 2002 (now abandoned), which was a U.S. national phase of PCT/DK01/00038, filed 18 Jan. 2001, which claimed priority of Danish Application PA 2000 00110, filed 21 Jan. 2000. All priorities are claimed.

FIELD OF THE INVENTION

The invention relates to the optimal adjustment of the signal processing in a hearing aid for the range of environments in which it is intended for use. More specifically the invention relates to a method for individual fitting of a hearing aid and a device adapted for facilitating this individual fitting.

BACKGROUND OF THE INVENTION

Today it is normal to adjust the signal processing parameters of a hearing aid for the individual patient by means of audiometric data defining the patient's hearing loss in a predefined frequency range, combined with a prescriptive amplification rationale which has proven suitable for the given patient's type of hearing loss. It is widely accepted that such a fitting will in most cases only give a rough estimate of the optimum hearing aid setting for the patient. It is therefore common practice subsequently to carry out a fine-tuning of the hearing aid's signal processing parameters in order to improve the sound quality as received by the patient. Such fine-tuning is normally based on subjective opinions expressed by the patient after using the hearing aid for some time. In this way it is possible to account in a rough way for the actual circumstances in which the patient spends time using the hearing aid. This approach relies on the dispenser to interpret the patient's description of specific listening situations, assess what acoustical or other features of those situations are causing difficulties, and specify appropriate alterations to the signal processing parameters of the hearing aid.

The objective of the present invention is to provide a method for fitting a hearing aid that is less time-consuming and more accurate than the previously known fitting methods.

A further objective of the present invention is to provide a device, which is suitable for use in a hearing aid fitting process according to the invention.

SUMMARY OF THE INVENTION

According to the invention the objective relating to the method is achieved by the method as defined in claim 1.

By collecting measurement data describing the environments in which the hearing aid is to be used, prior to the actual use of the hearing aid, it is possible to obtain a more reliable estimate of the actual needs of the hearing aid user. By specifying the alterations to the processing on the basis of (a) knowledge about relations between features of listening environments and optimal signal processing for those environments, combined with (b) actual measurements of features of the patient's listening environments a better approach to the fitting has been achieved and hence a less time-consuming fitting procedure is achievable.

Preferred embodiments are set forth in claims 2-4.

The embodiment in claim 2 will allow collection of data independent of the hearing aid use. This could for example be through use of a device adapted for this purpose, whilst the customised parts of the hearing aid are being manufactured, which often takes several days.

The embodiment of claim 3 provides the possibility of giving certain data a certain weight, hereby achieving a more correct fitting.

The embodiment of claim 4 provides the possibility of performing the data collection during normal hearing aid use and in a programming sequence preceding a future use performing a reprogramming based on the collected data.

According to the invention the objective relating to the device is achieved by the device as defined in claim 5.

By providing means for collecting and storing the data prior to the actual use of the hearing aid it is possible to sample long term statistical values and hence obtain a more reliable estimate of the actual needs of the hearing aid user. A better estimate for the initial fitting is achieved. This means that fewer fine tuning sessions are required and hence a less time-consuming fitting procedure is likewise achievable by use of such device.

Preferred embodiments are set forth in claims 6-9.

By the embodiment of claim 6 the device comprises the normal hearing aid components, i.e. the device is a hearing aid featuring the data collection ability.

By the embodiment in claim 7 the microphone is used for both audio data collection and the sound collection. A further possibility comprises providing a further microphone. According to claim 8 a switch may be provided for selecting different modes of the device.

The embodiment of claim 9 features a number of further sensors. The data collected by these sensors may likewise be used in the fitting procedure.

The invention will be described in more detail in the following description of the preferred embodiment with reference to the drawings.

DESCRIPTION OF THE PREFERRED EMBODIMENT

The invention may be implemented in a number of different manners, the two most preferred being as an element of a dispenser-controlled fitting procedure and as an integrated part of an adaptive hearing aid suitable for use in an adaptive fitting process. These are described below and are shown schematically in block diagrams of the drawings FIG. 1 and FIG. 2.

Figure 1:
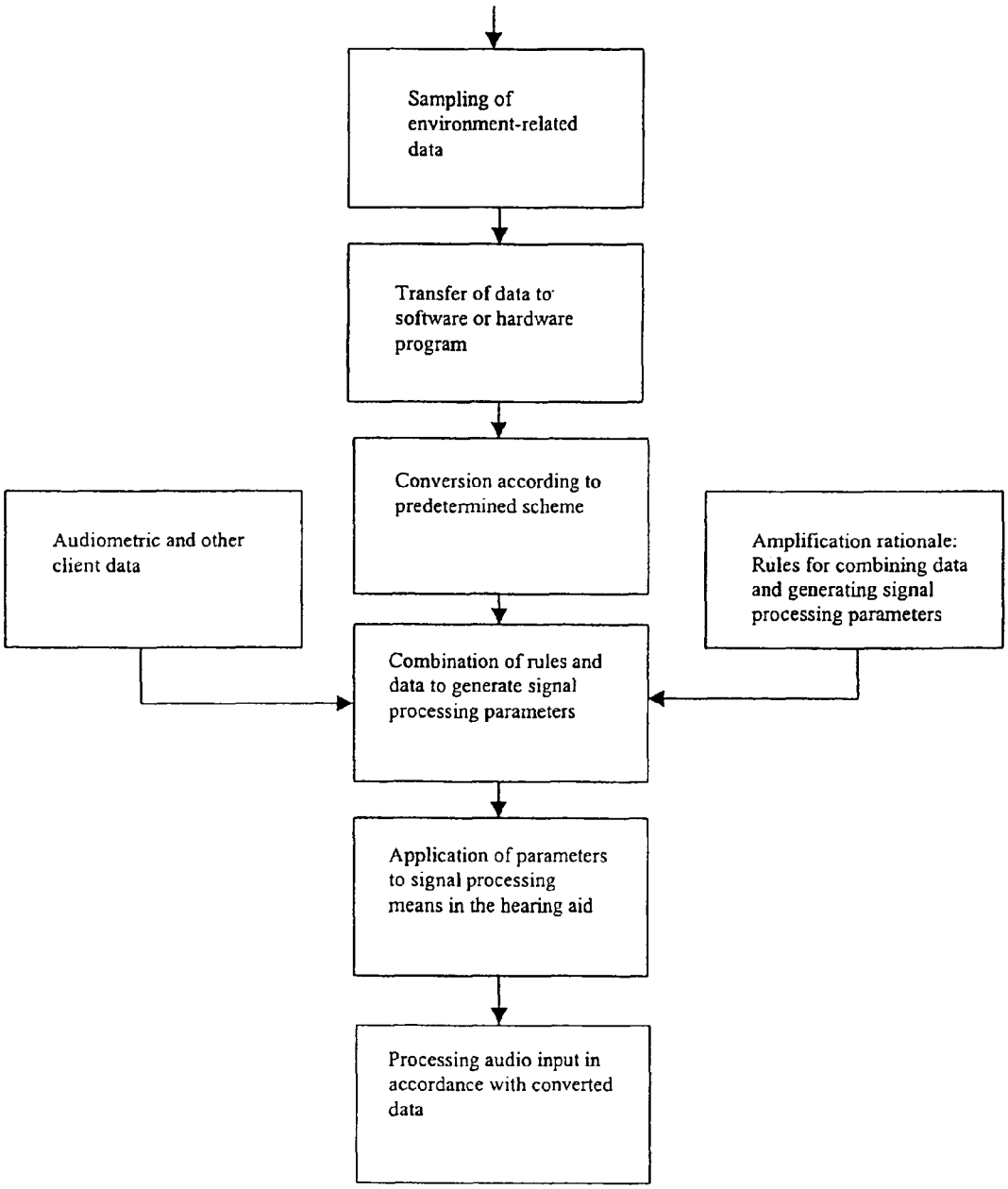
FIG. 1 is a diagram showing the invention as an element of a dispenser-controlled fitting procedure.

Referring now to FIG. 1 the invention implemented as a part of a dispenser-controlled procedure is explained. Typically, a hearing aid client does not receive a hearing aid at the first visit to the dispenser, but at a later date (for example after an earmould has been manufactured from an ear impression). With the present invention, instead of going home empty-handed to wait for the earmould to be produced, the client is given a portable or wearable device, which contains one or more physical sensors, some signal processing and a datalogger, and optionally includes a means for registering time intervals which the client considers to represent environments of particular importance. Whilst the client wears this device, it collects data on the environments experienced by the client. These data are used to improve the prescription of the final hearing aid when the client returns to the dispenser. Data to collect would very likely include levels and spectral distributions of sound across time, but need not be restricted to acoustical quantities if others are found to correlate with optimal hearing aid settings; possible candidates include but are not restricted to ambient or body temperature, light levels, amount of movement, cardiovascular activity, psychological stress.

Figure 2:
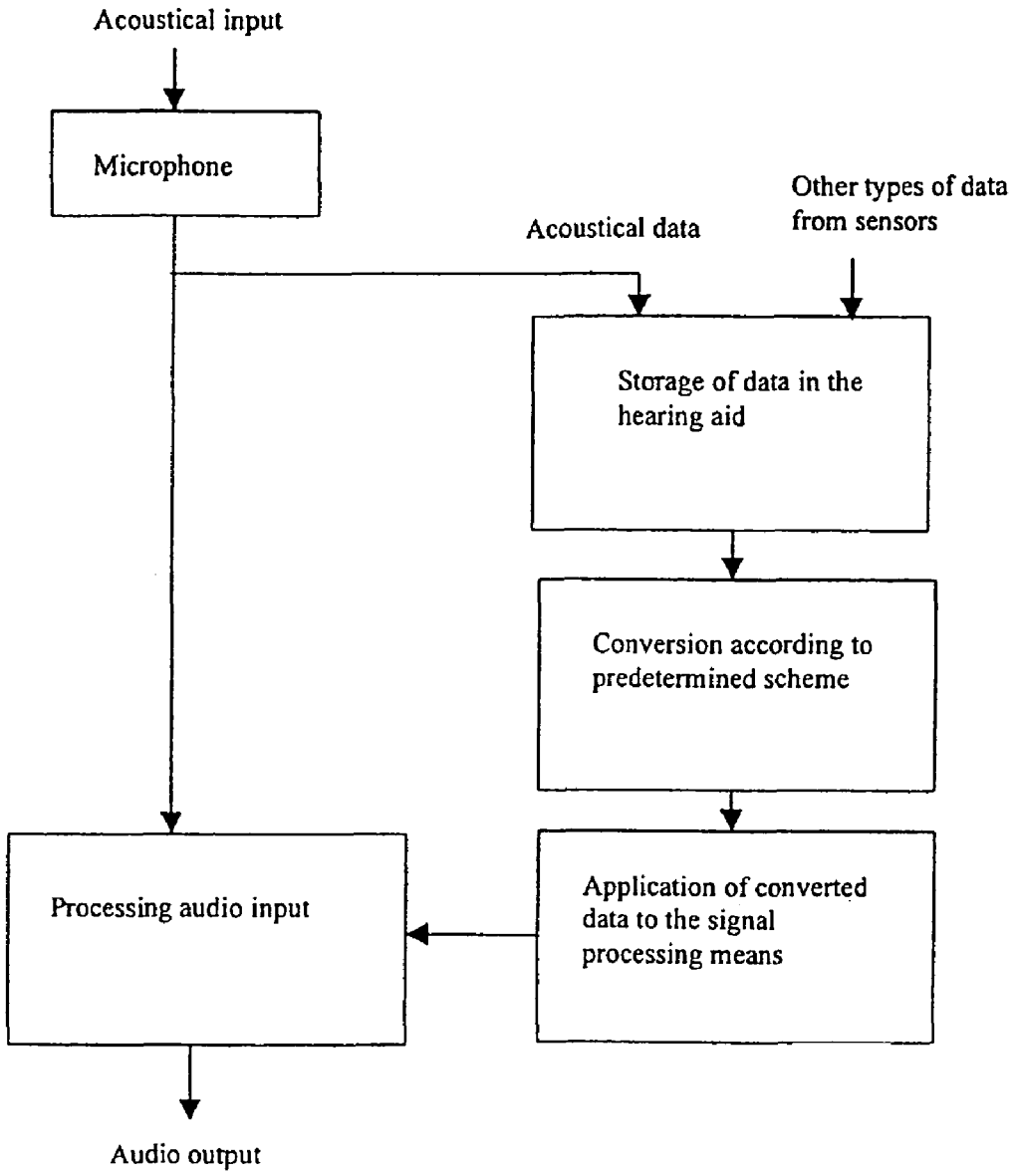
FIG. 2 is a diagram showing the invention as an integrated part of an adaptive hearing aid.

Referring now to FIG. 2 the invention implemented as a part of a hearing aid is explained. At the initial fitting session, the client's hearing aid is adjusted according to some standard prescriptive approach, or indeed by application of the method embodied above. Thereafter with the present invention, the hearing aid itself acts as a data collector, and includes means for using the data collected to generate alterations to the initial settings provided by the dispenser. These alterations might come into play automatically or when activated by the client. Such an embodiment would make it possible for the hearing aid itself to adjust its signal processing parameters as a consequence of for example altered social behavior resulting from hearing aid use or altered relative importance of different environments for the user.

As an example of the invention embodied as an element of a dispenser-controlled fitting procedure the following could be the case: A hearing impaired person has been provided with a measuring and recording device for collecting statistical data from the environments, which have importance for that person. The statistical data are afterwards, that means after a few days recording, analyzed by the hearing aid dispenser. This analysis may be done manually or may be done by a computer according to a program adapted for such analysis. The results of the analysis are afterwards used by the dispenser for selecting the correct initial adjustment of the hearing aid, which most often involves the selection of an amplification rationale that suits the person's hearing loss and afterwards tuning the parameters according to the actual needs indicated by the analysis of the environmental recording. For example, A person whose environments contain unusually high levels of high frequency components will need a lower high frequency gain.

The invention claimed is:

1. A method for fitting a hearing aid to the needs of a hearing aid user, the method comprising: collecting measurement data from environments experienced by said hearing aid user during normal use of said hearing aid, said measurement data including levels of sound across time, and adjusting said hearing aid based on said measurement data.

2. The method of claim 1, wherein said measurement data are collected within the hearing aid and said hearing aid adjusts itself based on said measurement data.

3. The method of claim 1, wherein said hearing aid is adjusted by a dispensing person based on said measurement data.

4. The method of claim 1, wherein said measurement data are collected over a period of a few days.

5. The method of claim 1, wherein said measurement data include at least one of ambient temperature, body temperature, light levels, amount of movement, cardiovascular activity and psychological stress.

6. The method of claim 1, wherein said measurement data include spectral distributions of sound across time.

7. The method of claim 1, wherein said measurement data include long term statistical values.

8. A hearing aid comprising a microphone for collecting acoustic signals and transforming said acoustic signals to electrical signals, processing means for processing said electrical signals, output means for generating an acoustic output signal from said processed electrical signals, and means for collecting measurement data from environments experienced by a user of said hearing aid, said measurement data including levels and spectral distributions of sound across time.

9. The hearing aid of claim 8, wherein said means for collecting measurement data include at least one sensor for detecting non-audio values selected from the group consisting of light level, body temperature, movement, cardiovascular activity and psychological stress.

* * * * *